US008382461B2

(12) United States Patent
Hedrich

(10) Patent No.: US 8,382,461 B2
(45) Date of Patent: Feb. 26, 2013

(54) VANE CELL PUMP AND IMPELLER HAVING A CHAMBER WALL WITH A PROJECTING WEB

(75) Inventor: Georg Hedrich, Nidderau (DE)

(73) Assignee: GM Global Technology Operations LLC, Detroit, MI (US)

( * ) Notice: Subject to any disclaimer, the term of this patent is extended or adjusted under 35 U.S.C. 154(b) by 490 days.

(21) Appl. No.: 12/360,670

(22) Filed: Jan. 27, 2009

(65) Prior Publication Data

US 2009/0269234 A1 Oct. 29, 2009

(30) Foreign Application Priority Data

Jan. 28, 2008 (DE) ..... 10 2008 006 289

(51) Int. Cl.
*F04C 2/00* (2006.01)
*F04C 14/18* (2006.01)

(52) U.S. Cl. ..... 418/26; 418/27; 418/30; 418/259; 417/220

(58) Field of Classification Search ..... 418/26–30, 418/259, 266–268; 417/220, 221
See application file for complete search history.

(56) References Cited

U.S. PATENT DOCUMENTS

| | | | | |
|---|---|---|---|---|
| 2,952,215 | A * | 9/1960 | Deschamps | 418/26 |
| 3,687,579 | A * | 8/1972 | Martin et al. | 418/26 |
| 4,531,893 | A * | 7/1985 | Okoh et al. | 418/26 |
| 5,690,479 | A | 11/1997 | Lehmann et al. | |
| 6,722,856 | B2 * | 4/2004 | Schneider | 418/30 |
| 2004/0166009 | A1 | 8/2004 | Nigrin | |
| 2007/0224067 | A1 | 9/2007 | Arnold et al. | |
| 2008/0304961 | A1 | 12/2008 | Bhogal et al. | |

FOREIGN PATENT DOCUMENTS

| | | | | |
|---|---|---|---|---|
| DE | 3614349 | A1 | 10/1987 | |
| DE | 4319200C1 | C1 | 7/1994 | |
| DE | 9320818 | U1 | 2/1995 | |
| DE | 19829726 | A1 | 1/2000 | |
| DE | 10142712 | A1 | 3/2003 | |
| DE | 102005048602 | A1 | 4/2007 | |
| JP | 03271581 | A * | 12/1991 | 418/30 |
| JP | 06066266 | A * | 3/1994 | 418/30 |
| WO | WO2007068101 | A1 | 6/2007 | |
| WO | 2010060416 | A2 | 6/2010 | |

* cited by examiner

*Primary Examiner* — Theresa Trieu
(74) *Attorney, Agent, or Firm* — Ingrassia Fisher & Lorenz, P.C.

(57) ABSTRACT

An impeller for a vane cell pump includes, but is not limited to vane receptacles for receiving an at least radially movable pump vane. A chamber wall is formed between two adjacent vane receptacles to form a conveying chamber. The chamber wall has an axially projecting web for delimiting a movement of a position ring with respect to the radial movement of the pump vane. The chamber wall includes, but is not limited to a first wall region for secure receiving of the respective pump vane in the vane receptacle. The chamber wall further includes, but is not limited to a second wall region for forming a web thickness d of the web for secure abutment of a sintering tool. In addition, the chamber wall has a third wall region for forming an enlarged conveying chamber volume. As a result, the impeller is easily manufactured and has an enlarged pump capacity for the same installation space.

9 Claims, 2 Drawing Sheets

VANE CELL PUMP AND IMPELLER HAVING A CHAMBER WALL WITH A PROJECTING WEB

CROSS-REFERENCE TO RELATED APPLICATION

This application claims priority to German Patent Application No. 102008006289.8, filed Jan. 28, 2008, which is incorporated herein by reference in its entirety.

TECHNICAL FIELD

The invention relates to an impeller for a vane cell pump, which can be mounted rotatably in a housing of the vane cell pump, to pump a fluid.

BACKGROUND

Known, for example, from DE 10 2005 048 602 A1 is a vane cell pump with an impeller that has a plurality of vane receptacles for receiving a radially movable pump vane. A chamber wall is formed between the adjacent vane receptacles. A part of the conveying chamber of the vane cell pump can be configured with the aid of the chamber wall. The conveying chamber is formed between a circular peripheral face of the impeller, which is interrupted by the vane receptacles, in order to form the chamber wall between the vane receptacles, the pump vanes, and a circular inner face of a housing ring disposed eccentrically with respect to the impeller.

In order that the pump vanes can abut against the inner face of the housing ring even at low rotational speeds, it is known from DE 101 42 712 A1 to expose the pump vanes to a spring force. Since the spring elements are an integral component of the impeller, however, assembly of the vane cell pump is rendered difficult since the pump vanes accommodated loosely in the vane receptacle can spring out of the vane receptacle when inserting the impeller into the housing ring. Furthermore, manufacture of the impeller is rendered difficult.

In addition, there is a continuous need to increase the pump capacity of a vane cell pump without enlarging the installation space.

In view of the foregoing, it is at least one object of the invention to provide an impeller for a vane cell pump, which is easy to manufacture and has an improved pump capacity for the same installation space. In addition, other objects, desirable features, and characteristics will become apparent from the subsequent summary or detailed description, and the appended claims, taken in conjunction with the accompanying drawings and this background.

The impeller according to an embodiment of the invention for a vane cell pump comprises a plurality of vane receptacles for receiving an at least a radially movable pump vane. A chamber wall is formed between two adjacent vane receptacles to form a conveying chamber. According to an embodiment of the invention, the chamber wall has an axially projecting web with the aid of which the movement of a position ring can be delimited with respect to the radial movement of the pump vane. The position ring is made, for example, of a resilient material, which abuts radially inward against the pump vanes, to press the pump vanes radially outward. The axially projecting web can prevent the pump vanes from being pressed completely out from the vane receptacle. According to an embodiment of the invention, the chamber wall comprises a first wall region for secure receiving of the respective pump vane in the vane receptacle and a second wall region for forming a web thickness of the web for secure abutment of a sintering tool, and a third wall region for forming an enlarged conveying chamber volume.

Since the circumferential surface of the impeller has a constant radius over the entire angular range, it is possible to realize several functions simultaneously due to the shape of the chamber wall. In the area of the vane receptacles, that is, in the direction of rotation of the impeller and opposite to the direction of rotation of the impeller directly adjoining the vane receptacle, the chamber wall is configured in such a manner that the material thickness in the circumferential direction and in the radial direction is sufficient to securely receive a pump vane without there being any risk of damage to the impeller or the pump vane during operation. In the second wall region, the material thickness in particular in the radial direction is selected in such a manner that during the manufacture of the impeller by sintering, the impeller cannot be damaged by a sintering tool before the sintering. In this case, it is taken into account that if the web thickness is selected to be too thin, this can lead to damage of the web during sintering. Furthermore, use is made here of the finding that merely a partial area of the chamber wall is sufficient to be able to move the impeller in the un-sintered state with the aid of a sintering tool. This finding makes it possible for the first time to provide the third wall region, which is dimensioned to form an enlarged conveying chamber volume and to this end in particular, has a particularly small material thickness. The dimensioning of the impeller in the area of the third wall region can in particular lead to a particularly smaller web thickness or even have the result that the web is completely omitted in this region, in order to achieve a radially inwardly extending curvature of the chamber wall or of the impeller, thus increasing the conveying chamber volume. As a result, the pump capacity is increased for the same installation space. Since the increased pump capacity is not achieved by an increased speed but by an increased conveying chamber volume, the risk of cavitations is not increased but is even reduced. Since the second wall region is selected to be sufficiently large for the abutment of a sintering tool and the third wall region is not necessary for this, a dimensioning can be selected in the third wall region, which need not be selected with regard to sufficient stability during sintering. The impeller is therefore simple to produce by sintering.

The third wall region preferably has at least one radius, in particular several radii, which is smaller than the radius of the first wall region and/or smaller than the radius of the second wall region. Due to the smaller radial extension of the impeller, the volume of the conveying chamber is increased so that a large volume flow can be pumped.

In particular, it is possible that the first wall region and the second wall region have the same radius. As a result, the sintering tool can act on the still un-sintered impeller directly adjacent to the vane receptacles so that the handling of the impeller during sintering is made easier. The second wall region particularly preferably has at least one radius, which is smaller than the radius of the first wall region. It is thereby possible that the second wall region also increases the volume of the conveying chamber formed due to a reduced extension in the radial direction of the impeller. At the same time, however, the conveying chamber volume is not increased so substantially that there is a risk of damage to the un-sintered impeller due to a sintering tool.

In a preferred embodiment, the third wall region is disposed in the direction of rotation of the impeller in relation to the second wall region. This has the result that during operation of the vane cells on transition from the suction mode to the pump mode, the lowest possible inflow velocity into the conveying chamber is ensured. The risk of cavitations can thus be reduced so that a higher rotational speed of the vane cell pump is possible. This additionally increases the pump capacity. During a rotation of the impeller, the third wall region is therefore moved before the second wall region over an inlet opening or an outlet opening.

Particularly preferably for each chamber wall precisely one second wall region and precisely one third wall region are provided between precisely two first wall regions. This allows a more regular configuration of the impeller. Furthermore, it is possible to configure the second wall region to be comparatively wide so that if the sintering tools are positioned inaccurately, the sintering tool comes to rest securely in the second wall region.

The second wall region and the third wall region preferably go over continuously into one another. This results in a uniform configuration of the chamber wall so that fluidically unfavorable flows such as, for example, turbulence at sudden changes in flow cross section can be avoided. The pump capacity is thus improved.

In particular, the web has a constant inside radius. This results in an impeller configuration which is easy to produce. Furthermore, the impeller can easily be mounted by inserting the impeller with the accommodated pump vanes into the housing ring and only then inserting the position ring. To this end, this position ring, which is in particular made of a flexible material, can initially be supported on the inner face of the web before the position ring is successively applied to the radially inner face of the respective pump vane. This facilitates assembly.

The embodiments of the invention further relate to a vane cell pump with the aid of which in particular engine oil of an automobile can be conveyed. The vane cell pump comprises a housing ring in which an impeller is preferably disposed eccentrically. The impeller can be configured and further developed as described previously. The vane receptacles of the impeller accommodate pump vanes against which a resilient position ring abuts radially inwardly. In each case, one conveying chamber is formed between the housing ring, the respective chamber wall, and the pump vanes assigned to the respective chamber wall. This vane cell pump has an increased pump capacity in relation to its installation space and can easily be produced.

It is particularly preferable if the housing ring which can be a part of the housing of the vane cell pump, is pivotally mounted under pretension in a plane of the impeller relatively movable to the impeller. As a result, it is possible for the impeller to abut against the housing ring in at least one position without the rotation of the impeller being hereby impaired. Due to the pivotability of the housing ring relative to the impeller, it is thus possible to achieve the largest possible different in the pump chamber volume.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background or summary or the following detailed description.

Figure 1:
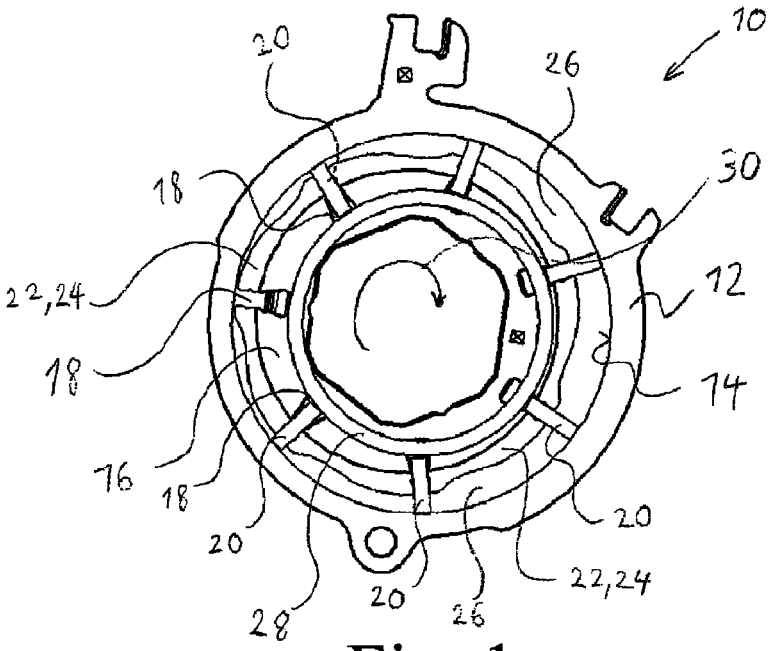
FIG. 1 shows a schematic side view of a vane cell pump.

The vane cell pump 10 shown in FIG. 1 comprises a housing ring 12 having a circular inner contour 14. Inside the housing ring 12, an impeller 16 is arranged eccentrically with respect to the housing ring 12. The impeller 16 has a plurality of vane receptacles 18, in which respectively one pump vane 20 is disposed. A chamber wall 22 is formed between two adjacent vane receptacles 18, which wall has a web 24 projecting in the axial direction in relation to the remaining impeller 16. The chamber wall 22, the pump vanes 20 respectively assigned to this chamber wall and the circular inner contour 14 of the housing ring 12 form a conveying chamber 26.

Located radially inward with respect to the pump vanes 20 is an elastic position ring 28, which abuts against the radially inwardly pointing face of the pump vanes 20 in order to press the pump vanes 20 radially outward, so that the pump vanes 20 abut against the inner contour 14 of the housing ring 12 even at low rotational speeds. The movement of the position ring 28 in the radial direction can be delimited by the web 24 of the wall 22, which rises from the remaining impeller 16 in the axial direction. In the exemplary embodiment shown the vane cell pump 10 or the impeller 16 has a direction of rotation 30 in the clockwise direction.

Figure 2:
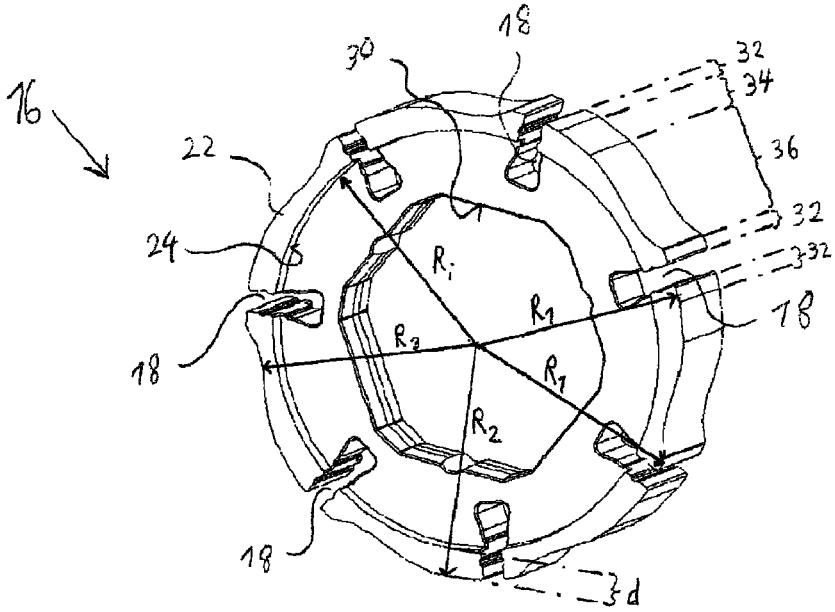
FIG. 2 shows a schematic perspective view of an impeller of the vane cell pump from FIG. 1

As shown in FIG. 2, the chamber wall 22 has a first wall region 32, which is adjoined by a second wall region 34. The second wall region 34 is in turn adjoined by a third wall region 36, which is in turn adjoined by a further first wall region 32. Two wall regions 32 disposed adjacently to one another enclose a vane receptacle 18 in each case. To this end, the first wall region 30 in each case has a first radius R1, which is selected in such a manner that during operation of the impeller 16 the pump vanes 20 are securely accommodated and any damage to the pump vane 20 or the impeller 16 in the area of the first wall region 32 is avoided. The second wall region 34 has a second radius R2, which is selected in such a manner that the web 24 has a web thickness d, which is sufficiently large that a sintering tool cannot damage the still un-sintered impeller 16 in the area of the web 24. In the exemplary embodiment shown, the web 24 has a constant inside radius R1. The third wall region 36 has at least one third radius R3, which leads to an increase in the conveying chamber volume. In particular, several third radii R3 are provided or the third radius R3 is constant over a specific angular range. Since the third radius R3 is smaller than the first radius R1 and the second radius R2, the conveying chamber volume is increased and the inflow and outflow speed is reduced so that for the same installation space, higher rotational speeds and higher conveying chamber volumes are possible without increasing the risk of cavitations.

The impeller 16 has a shaft receptacle 38, which in the exemplary embodiment shown, is configured to receive an angular drive shaft.

Figure 3:
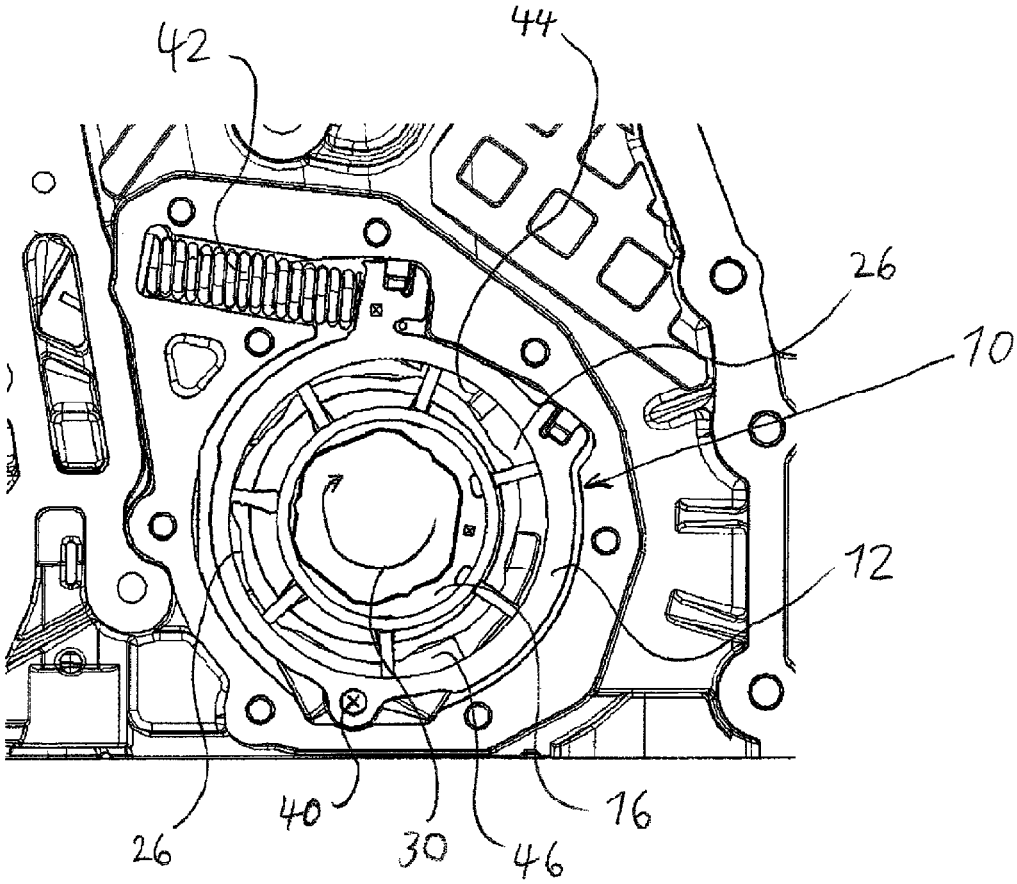
FIG. 3 shows a schematic side view of the vane cell pump from FIG. 1 in the installed state.

In the built-in state of the vane cell pump 10 as shown in FIG. 3, the housing ring 12 can be pivotally mounted about a pivot axis 40. The housing ring 12 is in particular pre-tensioned on an opposite side of the housing ring 12 to the pivot axis 40 with the aid of a spring 42 in such a manner that the housing ring 12 is pressed onto the impeller 16. As a result, in the exemplary embodiment shown, a particularly low conveying chamber volume is obtained in the left-hand area of the vane cell pump 10 and a particularly high conveying chamber volume is obtained on the right-hand side of the vane cell pump 10. An inlet channel 44 is provided in the upper area of the vane cell pump 10, which is swept by the conveying chamber 26 of the vane cell pump 10. Accordingly, an outlet channel 46 is provided in the lower area of the vane cell pump 10, which is swept by the conveying chambers 26.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. An impeller for a vane cell pump, comprising:

a plurality of vane receptacles adapted to receive an at least radially movable pump vane; and a chamber wall formed between two adjacent vane receptacles of the plurality of vane receptacles to form a conveying chamber, wherein the chamber wall has an axially projecting web adapted to delimit a radial movement of a position ring with respect to a radial movement of the at least radially movable pump vane, and wherein the chamber wall comprises a first wall region having a first radius and adapted to securely receive the at least radially movable pump vane in at least one of the plurality of vane receptacles, a second wall region having a second radius that is less than the first radius, the second wall region continuous with the first wall region and adapted to form a web thickness of the axially projecting web for secure abutment of a sintering tool, a third wall region having a third radius that is less than the second radius, the third wall region being curved and continuous with the second wall region and adapted to form an enlarged conveying chamber volume, and a fourth wall region having the first radius, the fourth wall region continuous with the third wall region.

2. The impeller according to claim 1, wherein the third wall region is disposed in a direction of rotation of the impeller in relation to the second wall region.

3. The impeller according to claim 1, wherein for each chamber wall, one second wall region and one third wall region are provided between the first wall region and the fourth wall region.

4. The impeller according to claim 1, wherein the axially projecting web has a constant inside radius.

5. A vane cell pump adapted to convey engine oil of an automobile, comprising:

a housing ring; and an impeller disposed inside the housing ring, said impeller comprising:

a plurality of vane receptacles adapted to receive an at least radially movable pump vane; and a chamber wall formed between two adjacent vane receptacles of the plurality of vane receptacles to form a conveying chamber, wherein the chamber wall has an axially projecting web adapted to delimit a radial movement of a position ring with respect to a radial movement of the at least radially movable pump vane, and wherein the chamber wall comprises a first wall region having a first radius and adapted to securely receive the at least radially movable pump vane in at least one of the plurality of vane receptacles, a second wall region having a second radius that is less than the first radius, the second wall region continuous with the first wall region and adapted to form a web thickness of the axially projecting web for secure abutment of a sintering tool, a third wall region having a third radius that is less than the second radius, the third wall region being curved and continuous with the second wall region and adapted to form an enlarged conveying chamber volume, and a fourth wall region having the first radius, the fourth wall region continuous with the third wall region.

6. The vane cell pump according to claim 5, wherein the housing ring is pivotally mounted under pretension in a plane of the impeller relatively movable to the impeller.

7. The vane cell pump according to claim 5, wherein the third wall region is disposed in a direction of rotation of the impeller in relation to the second wall region.

8. The vane cell pump according to claim 5, wherein for each chamber wall, one second wall region and one third wall region are provided between the first wall region and the fourth wall region.

9. The vane cell pump according to claim 5, wherein the axially projecting web has a constant inside radius.

* * * * *